US005488379A

United States Patent [19]

Jackson et al.

[11] Patent Number: 5,488,379

[45] Date of Patent: Jan. 30, 1996

[54] APPARATUS AND METHOD FOR POSITIONING AN ANTENNA IN A REMOTE GROUND TERMINAL

[75] Inventors: Thomas Jackson; Mark Murr, both of Frederick, Md.

[73] Assignee: Hughes Aircraft Company, Los Angeles, Calif.

[21] Appl. No.: 369,040

[22] Filed: Jan. 5, 1995

[51] Int. Cl.[6] ..... H01Q 3/00

[52] U.S. Cl. ..... 342/359

[58] Field of Search ..... 342/359

[56] References Cited

U.S. PATENT DOCUMENTS 4,675,688 6/1987 Sahara et al. ..... 343/765

4,801,940 1/1989 Ma et al. ..... 342/359

*Primary Examiner*—Theodore M. Blum

*Attorney, Agent, or Firm*—Gordon R. Lindeen, III; Wanda K. Denson-Low

[57] ABSTRACT

An apparatus for orienting a directional antenna of a remote ground terminal which receives a signal from a satellite. The apparatus includes a down-converter for demodulating the signal to an intermediate frequency signal. The down-converter includes an automatic gain control loop for maintaining the intermediate frequency signal at a predetermined power level. The apparatus further includes a controller coupled to the down-converter so as to monitor a voltage level of the automatic gain control loop. The apparatus also includes a controller operative to generate a difference signal corresponding to the difference of the voltage level when the signal from the satellite is being received by the down-converter from when the signal from the satellite is not received by the down-converter. The difference signal varies proportionally with the amplitude of the signal from the satellite received by the down-converter.

16 Claims, 3 Drawing Sheets

APPARATUS AND METHOD FOR POSITIONING AN ANTENNA IN A REMOTE GROUND TERMINAL

BACKGROUND OF THE INVENTION

Satellite communication systems typically have employed large aperture antennas and high power transmitters for establishing an uplink to the satellite. Recently, however, very small aperture antenna ground terminals, referred to as remote ground terminals, have been developed for data transmission at low rates. In such systems, the remote ground terminals are utilized for communicating via a satellite from a remote location to a central hub station. The central hub station communicates with multiple remote ground terminals, and has a significantly larger antenna, as well as a significantly larger power output capability than any of the remote ground terminals.

Typically, the remote ground terminals comprise a small aperture directional antenna for receiving and transmitting signals to a satellite, an outdoor unit mounted proximate the antenna which comprises a transmitter for producing and transmitting a modulated data signal and an indoor unit which demodulates incoming signals and also operates as an interface between a specific user's communication equipment and the outdoor unit.

The installation of such remote ground terminals entails positioning the directional antenna in the direction of the desired satellite so as to maximize the amplitude of the signal received from the satellite. Various techniques have been utilized to aim the antenna. One known technique is to couple a spectrum analyzer to the output of the demodulator of the indoor unit. The amplitude of the received signal is then monitored as the antenna position is adjusted. However, this technique has several drawbacks. First, it requires the use of additional equipment (i.e., the spectrum analyzer). Second, as the antenna is not located proximate the indoor unit, it requires the presence of two technicians to preform the installation.

U.S. Pat. No. 4,881,081 discloses a device for adjusting the antenna orientation which eliminates the need for two installation technicians. However, the device requires a substantial number of additional components which are dedicated exclusively for the purpose of antenna orientation.

Furthermore, the above devices typically operate as single carrier receivers (i.e., designed to receive a carrier signal having a single, predefined frequency) and therefore utilize a narrow band receiver to produce a narrow band intermediate frequency "IF" signal. The amplitude of the narrow band IF signal is then monitored as the position of the antenna is adjusted. The antenna is positioned correctly when the amplitude of the IF signal is the maximum obtainable value.

However, in systems which provide for a wide band IF signal, such as those capable of receiving multiple carrier frequencies, the foregoing methods are inadequate because the difference in the amplitude of the IF signal and the wide-band background noise output by the wide-band demodulator (i.e., the signal to noise ratio) is insufficient to allow the installer to readily determine when the antenna is pointed correctly. In other words, when monitoring the IF signal with a device such as a voltmeter, the background noise essentially masks the IF signal.

Accordingly, there exists a need for an apparatus and method for adjusting the antenna position of a remote ground terminal in systems providing for a wide band IF signal, which can be performed by a single technician and which does not require the use of additional components or equipment to perform the procedure.

SUMMARY OF THE INVENTION

The present invention provides an apparatus designed to satisfy the aforementioned needs. Specifically, the invention comprises an apparatus and method for utilizing the output of a wide-band receiver as an antenna pointing control signal in a remote ground terminal.

Accordingly, the present invention relates to an apparatus for orienting a directional antenna of a remote ground terminal which receives a signal from a satellite. The apparatus comprises a down-converter for demodulating the signal to an intermediate frequency signal. The down-converter includes an automatic gain control loop for maintaining the intermediate frequency signal at a predetermined power level. The apparatus further comprises a controller coupled to the down-converter so as to monitor a voltage level of the automatic gain control loop. The apparatus also includes a controller operative to generate a difference signal corresponding to the difference of the voltage level when the signal from the satellite is being received by the down-converter from when the signal from the satellite is not received by the down-converter. The difference signal varies proportionally with the amplitude of the signal from the satellite received by the down-converter.

The present invention also relates to a method for orienting a directional antenna of a remote ground terminal. The method comprises coupling the antenna to a down-converter operative to demodulate a signal incident on the antenna to an intermediate frequency signal. The down-converter comprises an automatic gain control loop for maintaining the intermediate frequency signal at a predetermined power level. The method further comprises determining and storing an off-pointed voltage level of the automatic gain control loop, where the off-pointed voltage level equals the output voltage level of the automatic gain control loop when no signal is incident on the antenna; monitoring the output voltage level of the automatic gain control loop when a signal is incident on the antenna so as to generate an on-pointed voltage level; generating a difference signal by computing the difference between the off-pointed voltage level and the on-pointed voltage level and adjusting the position of the antenna until the amplitude of the difference signal is maximized.

As described in detail below, the antenna positioning apparatus of the present invention provides important advantages. Most importantly, the present invention provides a means for generating an antenna control pointing voltage in a wide-band receiver which utilizes components contained in the remote ground terminal that are necessary for normal operation. Thus, the present invention minimizes the need for additional circuitry to position the antenna in a wide-band receiver system, and therefore reduces the cost of the remote ground terminal.

Another advantage is that the present invention significantly enhances the indication of the received signal strength by auto-calibrating out the off-pointed voltage level (i.e., noise) and then multiplying the difference signal by a predetermined factor so as to produce substantially zero to full scale deflection on the monitoring device which corresponds to an off-pointed and correctly pointed antenna, respectively.

The invention itself, together with further objects and attendant advantages, will best be understood by reference to the following detailed description, taken in conjunction with the accompanying drawings.

DETAILED DESCRIPTION OF THE DRAWINGS

Figure 1:
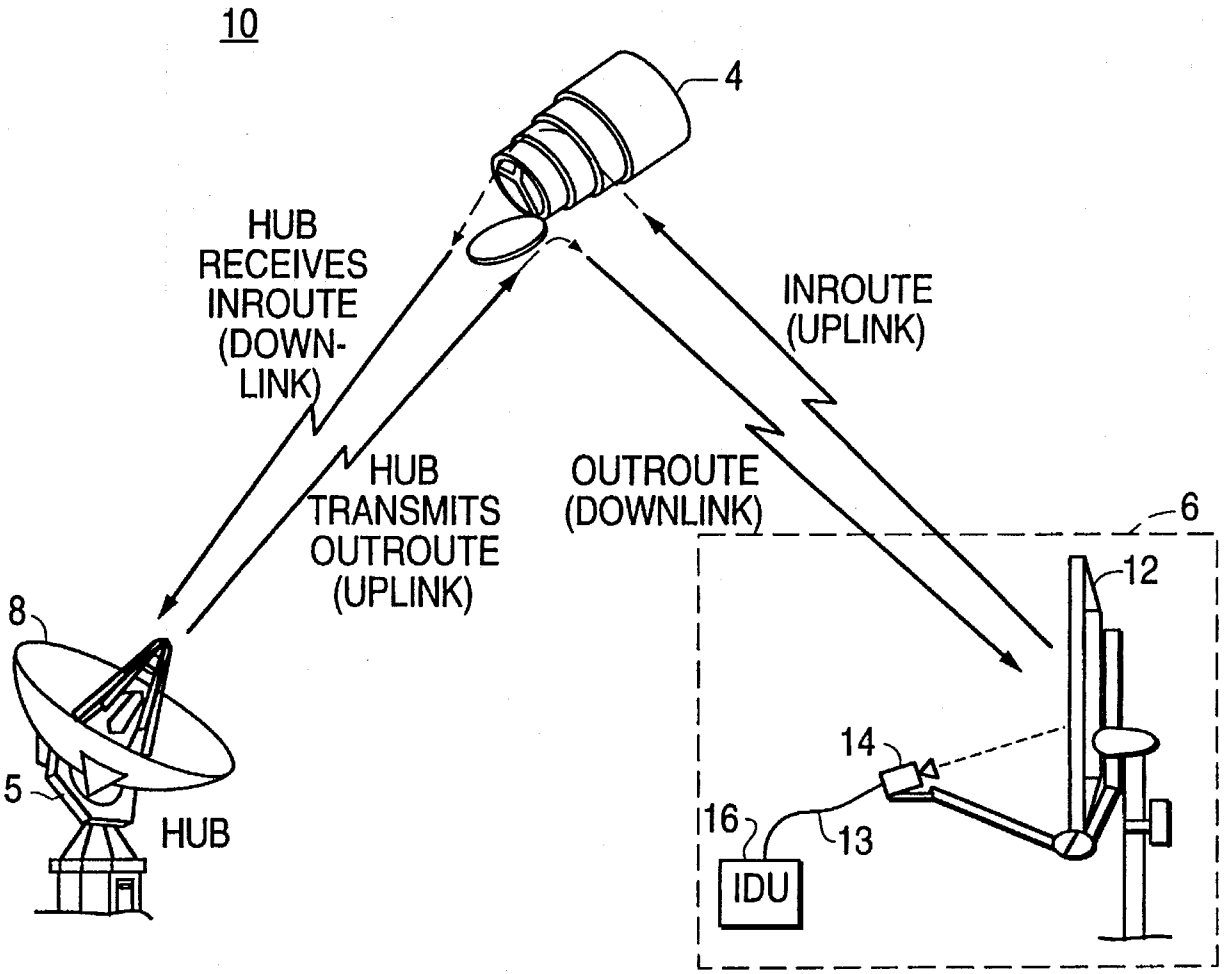
FIG. 1 is a block diagram of a very small aperture terminal ("VSAT") satellite communication network which utilizes the present invention.

The VSAT satellite communication network 10 illustrated in FIG. 1, comprises a central hub station 5, a communication satellite 4, and a plurality of remote ground terminals 6 (only one is shown). The VSAT network 10 functions as a two-way transmission system for transferring data and voice communications between the central hub station 5 and the numerous remote ground terminals 6. All data is transferred between the central hub station 5 and the remote ground terminals 6 via transponders located in the satellite 4. Signals transmitted from the central hub station 5 to the remote ground terminal 6 are referred to as "outroute," while signals transmitted in the opposite direction are referred to as "inroute."

As stated, the central hub station 5 supports a plurality of remote ground terminals 6. The central hub station 5 comprises a large antenna 8 so as to allow for the transmission of a signal sufficiently strong such that the signal can be received by the remote ground terminals 6 which have relatively small antennas. The large antenna 8 of the central hub station 5 also compensates for the relatively weak signals transmitted by the remote ground terminals 6.

As shown in FIG. 1, the communication satellite 4 functions as a microwave relay. It receives uplink signals from both the central hub station 5 and the remote ground terminals 6 at a first frequency and then retransmits the signal at a second frequency. The satellite 4 comprises a transponder which receives, amplifies and retransmits each signal within a predefined bandwidth. The transponders of the VSAT network 10 shown in FIG. 1 can operate in various frequency bands, for example, Ku and C band.

The remote ground terminal 6 comprises a small aperture antenna 12 for receiving (i.e., downlink) and transmitting (i.e., uplink) signals, an outdoor unit 14 typically mounted proximate the antenna 12 which comprises a transmitter for producing and transmitting a modulated uplink signal, and an indoor unit 16 which operates as an interface between a specific user's communication equipment and the outdoor unit 14.

In order for the remote ground terminal 6 to transmit and receive signals properly, the small aperture directional antenna 12 should be oriented at the satellite 4 so as to maximize the strength of the downlink signal received by the antenna 12.

Figure 2:
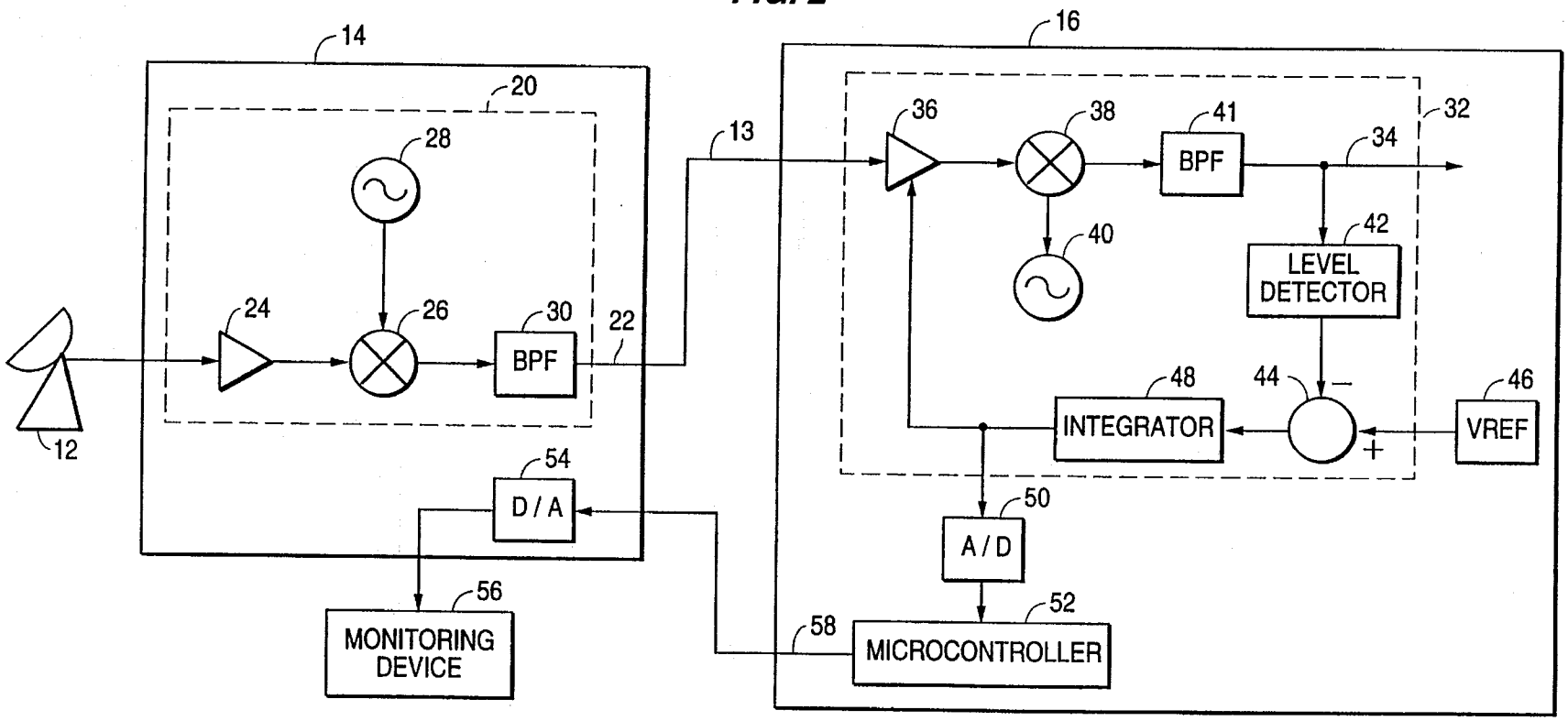
FIG. 2 is a block diagram of one embodiment of the present invention.

FIG. 2 illustrates one embodiment of the present invention. As shown in FIG. 2, incoming signals incident on the antenna 12 are coupled to a receiver chain 20 in the outdoor unit 14 and down-converted to a first IF signal 22. The first IF signal 22 is then coupled to the indoor unit 16 via an interfacility link 13, where as explained in further detail below, it is utilized to generate the antenna pointing control signal.

In one embodiment, the receiver chain 20 of the outdoor unit 14 comprises a low noise amplifier 24, a mixer 26, a local oscillator 28 and a band-pass filter 30 for down-converting the frequency of the received signal. The frequency of the local oscillator 28 is selected in accordance with the desired frequency of the first IF signal 22. Accordingly, if carrier signals having different frequencies are received, the frequency of the first IF signal 22 will also vary proportionally.

The first IF signal 22 is coupled to the indoor unit 16 via the interfacility link 13. The indoor unit 16 comprises a down-converter 32 which further reduces the frequency of the first IF signal 22 so as to generate a second IF signal 34. In one embodiment the down-converter 32 comprises a variable gain amplifier 36, a mixer 38, a local oscillator 40 and a band-pass filter 41.

Similar to the receiver chain 20 of the outdoor unit 14, as the frequency of the input signal to the down-converter varies, so will the frequency of the output signal 34 (i.e., the second IF signal). In some systems, the second IF signal 34 may be allowed to vary over the frequency range corresponding to one transponder, for example, 40 Mhz. Accordingly, in such a system, the bandwidth of the signal being monitored at the output of the down-converter 32 (i.e., the second IF signal) equals 40 Mhz.

The down-converter 32 further comprises an automatic gain control "AGC" loop which functions to maintain the output power level of the down-converter 32 at a pre-specified level. The AGC loop comprises a level detector 42, having an input coupled to the output of the down-converter 32; a voltage comparator 44 having a first input coupled to the output of the level detector 42 and a second input for receiving a reference voltage 46; and an integrator 48 having an input coupled to the output of the voltage comparator 44 and an output coupled to the variable gain amplifier 36 of the down-converter 32.

During operation the AGC loop functions to maintain the output of the down-converter 32 at a pre-specified level. Specifically, the power level of the second IF signal 34 is detected by the level detector 42 and compared to a predetermined reference voltage 46 by the voltage comparator 44. The predetermined reference voltage 46 is selected such that if the output of the level detector 42 is equal thereto, the power level of the second IF signal 34 is at the desired level. However, if the output of the level detector 42 does not equal the predetermined reference voltage 46, the voltage comparator 44 produces an error signal which causes the integrator 48 to either increase or decrease the gain of the variable gain amplifier 36 until the power level of the second IF signal 34 is at the desired level. The output of the integrator 48 is referred to as the AGC voltage level.

As shown in FIG. 2, the output of the integrator 48 is also coupled to an analog-to-digital "A/D" converter 50. The A/D converter 50 functions to transform the analog AGC voltage level into a digital data format. The output of the A/D converter 50 is coupled to a microcontroller unit 52.

The operation of the antenna positioning apparatus of the present invention is now described. The initial step entails generating an antenna pointing control signal offset using the following procedure. First, the installer positions the antenna 12 such that there is no possibility of pointing the antenna 12 at a satellite 4. This can be accomplished by pointing the antenna 12 at the ground. Accordingly, the receiver chain 20 of the outdoor unit 14 generates a noise signal representing either the background sky noise or the noise floor of the receiver chain 20. Similarly, the output of the down-converter 32 comprises a noise signal representing the noise signal generated by either the receiver chain 20 or the noise floor of the down-converter 32.

The noise signal generated by the down-converter 32 causes the AGC loop to produce a corresponding AGC voltage level, hereafter referred to as the "off-pointed" AGC voltage level. The analog off-pointed AGC voltage level is then converted to a digital equivalent by the A/D converter 50 and stored in the microcontroller 52. As explained below, the value of the off-pointed AGC voltage level is utilized as a reference, when performing subsequent AGC voltage level measurements to determine the position of the antenna 12.

The microcontroller 52 also functions to scale the value of the off-pointed AGC voltage level to either zero or full scale of a digital-to-analog "D/A" converter 54 which is utilized to drive a monitoring device 56. For example, if the D/A converter 54 was an 8 bit D/A converter, the microcontroller 52 would scale the off-pointed AGC voltage level to either 0 or 255 decimal. The scaling function is performed to facilitate the reading of the monitoring device 56, for example, a voltmeter, by the installer.

Upon storing the off-pointed AGC voltage level, the installer moves the antenna in the direction of the desired satellite 4. As a signal is received by the antenna 12, the power level of the wide-band IF signal 34 output by the down-converter 32 increases. This causes the AGC loop of the down-converter to decrease the AGC voltage level, as less amplification is required by the variable gain amplifier 36 of the down-converter 32. In the present embodiment, the AGC voltage level varies inversely proportional with the strength of the received signal.

Moreover, as the installer moves the antenna 12, the AGC voltage level is monitored by the microcontroller 52. The microcontroller 52 operates to compare the current AGC voltage level with the off-pointed AGC voltage level previously stored to determine any difference between the two levels and to generate an output signal 58 which represents the difference between the two AGC voltage levels. This output signal 58 is hereinafter referred to as the difference signal. Thus, the amplitude of the difference signal 58 varies proportionally with the strength of the received signal. As explained below, the amplitude of the difference signal 58 is monitored and utilized to determine the correct position of the antenna 12.

The difference signal 58 output by the microcontroller 52 is coupled to the D/A converter 54 utilized to drive the monitoring device 56. The difference signal 58 is multiplied by a predetermined factor by the microcontroller 52 so as to increase the deflection of the monitoring device 56. Accordingly, as the difference signal 58 increases so does the deflection of the monitoring device 56. The monitoring and comparison of the current AGC voltage level and the off-pointed AGC voltage level occurs continuously when the remote ground terminal 6 is in an antenna alignment mode. (Although shown as a separate connection, the difference signal 58 can be coupled to the outdoor unit 14 via the interfacility link 13.)

As mentioned above, the microcontroller 52 also functions to scale the off-pointed AGC voltage level to either zero or full scale of the digital-to-analog "D/A" converter 54 coupled to the monitoring device 56. Similarly, the microcontroller 52 also operates to scale the difference signal 58 prior to outputting the difference signal 58 to the D/A converter 54.

For example, in one embodiment, the off-pointed AGC voltage level is scaled to "full-scale" or 255 decimal, assuming an 8 bit D/A converter is utilized. The difference signal 58, is multiplied by a factor of 4, and then scaled to a number between 128 and 255 decimal. In this case, a difference signal 58 of 255 decimal indicates the difference signal 58 equals zero and results in full scale deflection of the monitoring device 56, while a difference signal 58 of 128 represents the maximum expected value of the difference signal 58 and results in ½ scale deflection of the monitoring device 56.

Utilizing the above example, in accordance with the present invention, during antenna installation the installer adjusts the antenna 12 until the deflection of the monitoring device 56 is minimized. In other words, the maximum expected value of the difference signal (i.e., 128 decimal) indicates the antenna is correctly pointed at the satellite, while a difference signal of 255 decimal indicates that no signal is being received. Of course, the present embodiment could be modified such that the maximum obtainable reading on the monitoring device 56 indicates the strongest signal received from the satellite 4.

Figure 3:
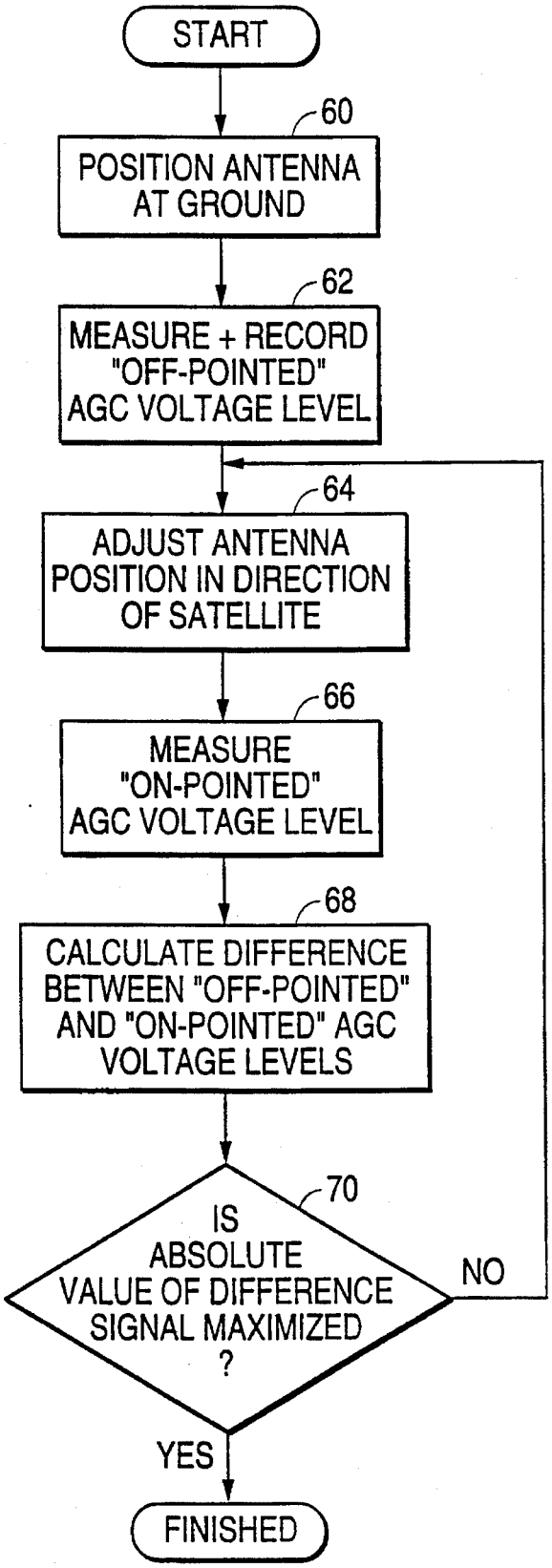
FIG. 3 is a flow chart which illustrates the antenna positioning procedure of the present invention.

FIG. 3 is a flow chart which illustrates the antenna positioning procedure described above. To summarize, in the first step 60 the antenna is positioned away from the satellite (i.e., "off-pointed"), preferably at the ground. The second step 62 entails measuring and recording the voltage level of the output of the AGC loop. Step three 64 requires the installer to position the antenna 12 in the direction of the satellite 4. In the fourth step 66, the voltage level of the output of the AGC loop (i.e., the "on-pointed" level) is automatically recorded by the microcontroller 52 . In the fifth step 68, the microcontroller 52 calculates the difference between the "off-pointed" and "on-pointed" AGC voltage levels. The sixth step 70 requires the installer to adjust the position of the antenna 12 until the absolute value of the difference signal 58 is maximized. Once the absolute value of the difference signal 58 is maximized, the antenna 12 is properly positioned.

It is of note that when attempting to orient the antenna 12 in the direction of the transmitting satellite 4, the remote ground terminal 6 is commanded into an alignment mode. In this mode, the remote ground terminal 6 receives signals in the same manner as when the remote ground terminal 6 is in the normal mode of operation. However, in the alignment mode, the outdoor unit 14 is prevented from transmitting any signals to the satellite 4.

The antenna positioning apparatus of the present invention provides numerous advantages. The novel antenna positioning apparatus provides a means for generating an antenna control pointing voltage in a wide-band receiver which utilizes components contained in the remote ground terminal that are necessary for normal operation. Thus, the present invention minimizes the need for additional circuitry to position the antenna in a wide-band receiver, and therefore reduces the cost of the remote ground terminal.

Another advantage is that the present invention significantly enhances the indication of the received signal strength by auto-calibrating out the off-pointed voltage level (i.e., noise) and then multiplying the difference signal by a predetermined factor so as to produce substantially zero to full scale deflection on the monitoring device which corresponds to an off-pointed and correctly pointed antenna, respectively.

Numerous variations of the foregoing invention are also possible. For example, the controller utilized to compute the difference signal can be replaced by dedicated hardware designed to implement the functions detailed above. In the preferred embodiment, the controller utilized to control the overall operation of the indoor unit, is also utilized to perform the functions of the present invention. Further, the components utilized to perform the present invention can be located in the outdoor unit. In addition, down-converters having different designs can be utilized.

Of course, it should be understood that a wide range of other changes and modifications can be made to the preferred embodiment described above. It is therefore intended that the foregoing detailed description be regarded as illustrative rather than limiting and that it be understood that it is the following claims, including all equivalents, which are intended to define the scope of the invention.

What is claimed is:

1. An apparatus for orienting a directional antenna of a remote ground terminal which receives a signal from a satellite, said apparatus comprising:

a down-converter for demodulating said signal to an intermediate frequency signal, said down-converter comprising an automatic gain control loop for maintaining said intermediate frequency signal at a predetermined power level;

a controller coupled to said down-converter so as to monitor a voltage level of said automatic gain control loop, said controller operative to generate a difference signal corresponding to the difference of said voltage level when said signal from said satellite is being received by said down-converter from when said signal from said satellite is not received by said down-converter, wherein said difference signal varies proportionally with the amplitude of said signal from said satellite received by said down-converter, said difference signal used for orienting said directional antenna.

2. The apparatus of claim 1, wherein said down-converter is a wide-band receiver.

3. The apparatus of claim 1, further comprising a monitoring device coupled to said controller so as to receive said difference signal, said monitoring device capable of indicating the amplitude of said difference signal.

4. The apparatus of claim 3, wherein said controller multiplies the difference signal by a predetermined factor so as to increase the amplitude of said difference signal.

5. The apparatus of claim 1, wherein said down-converter comprises a variable gain amplifier having an output coupled to a first input of a mixer, a local oscillator coupled to a second input of said mixer, and a band-pass filter coupled to an output of said mixer.

6. The apparatus of claim 5, wherein said automatic gain control loop comprises:

a level detector having an input coupled to an output of said band-pass filter, said level detector operative to produce a signal corresponding to the amplitude of said intermediate frequency signal;

a voltage comparator having a first and second input, said first input coupled to an output of said level detector, said second input coupled to a reference voltage, said voltage comparator operative to produce an output signal if said signal produced by said level detector is less than said reference voltage; and an integrator coupled to an output of said voltage comparator, and operative to produce an output signal which increases the gain of said variable gain amplifier and which represents said voltage level of said automatic gain control loop.

7. The apparatus of claim 6, further comprising an analog to digital converter having an input coupled to an output of said integrator and an output coupled to said controller, said analog to digital converter operative to convert said voltage level of said automatic gain control loop into a digital format.

8. The apparatus of claim 7, wherein said difference signal is generated by said controller in a digital format and is coupled to a digital to analog converter so as to produce said difference signal in an analog format.

9. The apparatus of claim 1, wherein said controller is a microprocessor.

10. A method for orienting a directional antenna of a remote ground terminal which receives a signal from a satellite, said method comprising:

coupling said antenna to a down-converter, said down-converter operative to demodulate a signal incident on said antenna to an intermediate frequency signal, said down-converter comprising an automatic gain control loop for maintaining said intermediate frequency signal at a predetermined power level;

determining and storing an off-pointed voltage level of said automatic gain control loop, said off-pointed voltage level equalling the output voltage level of said automatic gain control loop when no signal is incident on said antenna;

monitoring the output voltage level of said automatic gain control loop when a signal is incident on said antenna so as to generate an on-pointed voltage level; and generating a difference signal by computing the difference between the off-pointed voltage level and the on-pointed voltage level, said difference signal used for orienting said directional antenna.

11. The method of claim 10, further comprising coupling said difference signal to a monitoring device and adjusting the position of said antenna until the amplitude of said difference signal is maximized, said monitoring device capable of indicating the amplitude of said difference signal.

12. The method of claim 10, wherein said down-converter is a wide-band receiver.

13. The method of claim 11, further comprising multiplying said difference signal by a predetermined factor so as to increase the amplitude of said difference signal.

14. The method of claim 10, wherein said down-converter comprises a variable gain amplifier having an output coupled to a first input of a mixer, a local oscillator coupled to a second input of said mixer, and a band-pass filter coupled to an output of said mixer.

15. The method of claim 14, wherein said automatic gain control loop comprises:

a level detector having an input coupled to an output of said band-pass filter, said level detector operative to produce a signal corresponding to the amplitude of said intermediate frequency signal;

a voltage comparator having a first and second input, said first input coupled to an output of said level detector, said second input coupled to a reference voltage, said voltage comparator operative to produce an output signal if said signal produced by said level detector is less than said reference voltage; and an integrator coupled to an output of said voltage comparator, and operative to produce an output signal which increases the gain of said variable gain amplifier and which represents said voltage level of said automatic gain control loop.

16. The method of claim 10, wherein a microprocessor is utilized to generate said difference signal, and to multiply said difference signal by said predetermined factor.

* * * * *